US012091200B2

(12) United States Patent
Look et al.

(10) Patent No.: US 12,091,200 B2
(45) Date of Patent: Sep. 17, 2024

(54) PACKAGING MACHINE AND METHOD FOR PACKAGING A CONTAINER GROUP CONSISTING OF MULTIPLE CONTAINERS

(71) Applicant: KHS GmbH, Dortmund (DE)

(72) Inventors: Johannes Look, Kleve (DE); Alexander Hermsen, Kleve (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 18/026,252

(22) PCT Filed: Oct. 4, 2021

(86) PCT No.: PCT/EP2021/077229
§ 371 (c)(1),
(2) Date: Mar. 14, 2023

(87) PCT Pub. No.: WO2022/078789
PCT Pub. Date: Apr. 21, 2022

(65) Prior Publication Data

US 2023/0331414 A1 Oct. 19, 2023

(30) Foreign Application Priority Data

Oct. 13, 2020 (DE) ..... 10 2020 126 787.8

(51) Int. Cl.
*B65B 17/02* (2006.01)
*B65B 5/02* (2006.01)
(Continued)

(52) U.S. Cl.
CPC ..... *B65B 17/025* (2013.01); *B65B 5/026* (2013.01); *B65B 61/08* (2013.01); *B65B 65/003* (2013.01); *B65B 65/02* (2013.01)

(58) Field of Classification Search
CPC ..... B65B 17/025; B65B 5/026; B65B 61/08; B65B 65/003; B65B 65/02
(Continued)

(56) References Cited

U.S. PATENT DOCUMENTS 3,013,796 A 12/1961 Currie et al.
4,231,209 A * 11/1980 Walker ..... B65B 17/025 53/48.5
(Continued)

FOREIGN PATENT DOCUMENTS

DE 1461824 A1 3/1969
DE 102009026220 A1 1/2011
(Continued)

OTHER PUBLICATIONS

International Search Report, PCT Application No. PCT/EP2021/077229, mailed Mar. 3, 2022 (7 pages).

*Primary Examiner* — Stephen F. Gerrity
*Assistant Examiner* — Linda J Hodge
(74) *Attorney, Agent, or Firm* — Occhiuti & Rohlicek LLP

(57) ABSTRACT

A tray packer includes a positioning-and-folding unit, an application unit, and a storage-and-feed unit. The positioning-and-folding unit arranges a container group on a packaging blank's bottom and places its sides against the group. The application unit places a material blank on the group opposite the bottom portion such as to form a bundle. The storage-and-feed unit stores and provides the material blanks to the application unit. The application unit comprises a pressing element that comprises a tool plate that moves continuously on a circular path in such a way that the tool plate adjusts between engagement positions with the containers. The circular path spans a plane oriented parallel to a transport plane along which the groups travel.

15 Claims, 9 Drawing Sheets

(51) Int. Cl.
*B65B 61/08* (2006.01)
*B65B 65/00* (2006.01)
*B65B 65/02* (2006.01)

(58) Field of Classification Search
USPC ..... 53/48.1, 398
See application file for complete search history.

(56) References Cited

U.S. PATENT DOCUMENTS

| | | | | |
|---|---|---|---|---|
| 2010/0042254 | A1* | 2/2010 | Van Heek | B65B 43/185<br>271/145 |
| 2014/0305075 | A1 | 10/2014 | Bonnain | |
| 2020/0361645 | A1* | 11/2020 | Spindler | B65B 17/025 |
| 2021/0053704 | A1* | 2/2021 | Edwards | B65B 35/30 |
| 2021/0221589 | A1* | 7/2021 | Bates | B65B 17/025 |

FOREIGN PATENT DOCUMENTS

| | | | | |
|---|---|---|---|---|
| DE | 102017116743 | A1 * | 1/2019 | B65B 17/025 |
| EP | 2239200 | B1 | 6/2016 | |
| EP | 3212508 | B1 | 5/2020 | |
| WO | 9629247 | A1 | 9/1996 | |
| WO | WO-02060780 | A2 * | 8/2002 | B65B 17/025 |
| WO | WO-2012152390 | A1 * | 11/2012 | B65B 21/245 |

* cited by examiner

PACKAGING MACHINE AND METHOD FOR PACKAGING A CONTAINER GROUP CONSISTING OF MULTIPLE CONTAINERS

RELATED APPLICATIONS

This is the national stage of PCT/EP2021/077229, filed on Oct. 4, 2021, which claims the benefit of the Oct. 13, 2020 priority date of German application DE 102020126787.8, the contents of which are incorporated herein by reference.

FIELD OF INVENTION

The invention relates to packaging machines and, in particular, to packaging machines for packaging groups of containers.

BACKGROUND

Within the container packaging industry, it is often desirable to package multiple containers into one saleable unit. For example, at the retain level, drinks are often sold in sixpacks or four-packs.

It is desirable for the containers in such a package to be stable relative to each other. This promotes ease of transport and handling. In addition, a tidy arrangement of containers provides a consumer with a more pleasing impression and thus may promote ultimate purchase of the package.

In some cases, the packaging process includes enclosing the group of containers in a packaging blank or on a tray.

SUMMARY

In one aspect, an apparatus includes a positioning-and-folding unit for arranging the container group on the bottom portion of the packaging blank and for the lateral contact of the side portions of the packaging blank to the container group and a transport unit for conveying the container group along a transport plane through the packaging machine.

In one aspect, a packaging machine according to the invention includes an application unit for the applying opposite the bottom portion, in particular applying so as to form a bundle, of a material blank to the container group. The material blank and the packaging blank are separate. They are not connected to each other.

Such an application unit comprises at least one pressing element, which comprises a tool plate that moves continuously around a circular path. The tool plate can be adjusted between an outer engagement position and an inner engagement position with the containers. The circular path spans a plane that is oriented perpendicular to the transport plane. In addition, the packaging machine includes a storage-and-feed unit for storing and providing the material blank to the application unit.

A variety of container groups are contemplated. These include containers with four, six, or eight containers. These are typically arranged in corresponding arrays, namely a 2×2 arrangement, a 3×2 array, or a 4×2 array.

In a typical container group, the containers are beverage containers or containers for fluid foodstuffs. Such containers include bottles, cans, and similar containers.

The application unit connects the material blank to a portion of the container group that is opposite its bottom portion, for example at the top or along the upper sides of the containers. This allows the blank to stabilize the containers.

It is during the displacement of the tool plate out of the outer engagement position with the containers and into the inner engagement position with the containers that application of the material blank takes place. In the inner engagement position of the material blank, depending on the configuration of the inner engagement position, i.e. the maximum movement in the direction towards the containers, the material blank is placed at or on the containers. Bringing the material blank into position forms a positive-fit connection between the material blank and the container group's individual containers. As a result, the material blank produces a particularly stable connection that forms a bundle.

The packaging machine's operation thus results in a particularly simple and economical way to produce a stable package for a container group. The packaging process runs continuously due to the continues movement of pressing elements along a circular path. Moreover, it is a simply matter to adjust the rate of rotation of the pressing elements to accommodate different transport speeds of the containers.

The existence of a storage-and-feed unit for storing and providing the material blanks to the application unit further promotes continuous operation of the packaging machine.

As a result of the operation of the foregoing features, it is possible to reliably arrange a container group in a stable package that has been delimited on its top side by the material blank, on its bottom side by the packaging blank, and on its sides by side portions of the packaging blank that, after having been folded, are arranged essentially perpendicular to the bottom portion and in contact with at least some of the container group's walls.

The assembly of the containers to form a container group can in principle take place in any desired manner, for example by means of a grouping device located upstream of a packaging machine following which the grouped containers are delivered to the packaging machine by means of a suitable transport device.

According to one particularly advantageous embodiment of the invention, however, a formatting unit forms a container group, the application unit follows the formatting unit in the transport direction, and the positioning-and-folding unit follows along the transport direction onto the application unit.

In some embodiments, in addition to the positioning-and-folding unit, the transport unit, the application unit, and the storage-and-feed unit, the packaging machine comprises a formatting unit that assembles the containers being delivered to the packaging machine into a predetermined container group. Among these are embodiments in which the formatting unit is adjustable so as to allow forming different container group sizes.

In some embodiments, as seen in the transport direction, the application unit follows the formatting unit and the positioning-and-folding unit follows the application unit. In such embodiments, material blanks are applied to the top sides following the production of the container group. Following this, the packaging blank is applied to the container group with the container group arranged on the bottom portion and the side portions being folded in such a way that they are then oriented essentially perpendicular to the bottom portion of the packaging blank.

As used herein, an arrangement described as "following one another" or "connecting" is understood to be both an arrangement of the units of the packaging machine in which they directly delimit one another as well as an arrangement in which the units of the packaging machine are not connected to one another directly but with the intermediate engagement of other function units. A direct arrangement of the units following results in a particularly simple and compact packaging machine.

According to one alternative embodiment of the invention, the positioning-and-folding unit follows the formatting unit in the transport direction and the application unit follows the positioning-and-folding unit in the transport direction.

In some embodiments, the container group is assembled by assembling a predetermined number of containers in the formatting unit, after which it is arranged in the positioning-and-folding unit on the bottom portion of a packaging blank. The packaging blank's side portions are then laid laterally onto the side of the container group. It is only after the container group has been arranged in the packaging blank that the application unit then arranges the material blank in the region of the containers' top sides, which are opposite the base portions thereof.

In some embodiments, the packaging machine is configured to apply a film to cover a container group. A suitable film is a shrink film. Among these are embodiments that include a shrink tunnel for shrinking the film.

Those embodiments that apply a film allow particularly versatile use of the packaging machine. Such an embodiment is able to, for example, shrink a film around one container group alone, thus omitting a packaging blank. Alternatively, such an embodiment is able to shrink film onto a container group arranged in a packaging blank. In addition, there exists a possibility of using the film as a supplement to a container group that has been arranged in a packaging blank and that has been provided with a material blank. This supplemental stabilization by the film further promotes the stability of the packaged container groups.

The specific configuration of the material blanks is freely selectable. Particularly useful material blanks are boards, such as corrugated board or cardboard.

A typical material blank has several holes through which upper portions of containers can be guided. Fixing elements along each hole's circumference are inclined relative to the material blank's base surface. These fixing elements provide a positive-fit connection with the containers. In some embodiments, the fixing elements comprise teeth.

The arrangement of material blanks depends on the nature of the container groups to be formed. In some embodiments, the material blanks are arranged in individual form in the storage-and-feed unit from which they are continuously delivery to the application unit.

In an alternative embodiment, material blanks are selected for arrangement adjacent to one another in the application unit so as to form container groups arranged within the application unit. In such embodiments, each material blank comprises container-group blanks that correspond to the individual container groups. These are then separated from each other to separate the container groups. In such embodiments, the container group blanks connect to each other using perforations or individual webs. Following the application of the material blanks to the container groups, these perforations and webs allow for easy separation.

The use of material blanks with individual container-group blanks therefore allows the application unit to connect several container groups to one material blank at the same time and for these container groups to later be separated. In a preferred embodiment, the application unit is configured for separating the material blanks, for example by having a tool plate that has cutting elements for separating connecting webs that hold the material blank's container-group blanks together.

According to this embodiment, the application unit also separates container-group blanks for each other by having cutting elements that are configured to reliably separate the container-group blanks from each other. Examples of cutting elements include cutting blands and separation elements arranged at corresponding points on the tool plate.

Embodiments further include those in which the application unit comprises a drive unit that is configured to move the pressing element in such a way that the tool plate is adjustable between an outer engagement position and an inner engagement position with the containers. In such embodiments, the drive unit comprises a first drive disk, which can be rotated about a first rotation axis, and a second drive disk. The second drive disk is arranged parallel to and at a distance from the first drive disk, and that can be rotated about a second rotation axis. The first and second rotation axes are oriented perpendicular to the transport direction and embedded in a plane that is parallel to the transport plane. In addition, the first and second rotation axes are offset relative to each other along the transport direction. In such embodiments, the pressing element comprises first and second jointed axles.

The first jointed axle connects the pressing element in a jointed manner to the first drive disk. The second joined axle connects it to the second drive disk. The connection is such that as the two drive disks rotate, the tool plate remains parallel to the transport plane.

The connection of the jointed axles of the pressing element to the first and second drive disks means that, as the drive disks rotate, the tool plate at the pressing element remains parallel to the transport plane along which the container groups move past the application unit in the transport direction. As a result of having been aligned reliably to be parallel to the transport plane, the tool plate guides or holds the material blank horizontally as it is applied to the containers and does so with considerable reliability.

The material blank is applied during the movement of the tool plate out of the outer engagement position with the containers into the inner engagement position with the containers. In the inner engagement position, the material blank is placed at or on the containers in a manner that depends on the configuration of the inner engagement position, i.e. the maximum displacement in the direction onto the containers. A positive-fit connection of the material blank is formed with the container group's containers. This results in a stable package.

A packaging machine according to this further embodiment of the invention is characterized in that it can be produced particularly easily and economically, and that a reliable horizontal alignment of the tool plates of the pressing elements can be achieved by a corresponding arrangement of the two jointed axles of the pressing elements in relation to the drive disks. Deviations of the tool plate from the alignment parallel to the transport plane, as required for fault-free operation, will be particularly effectively avoided by this arrangement. In this situation, by means of the rotation speed of the drive disks about their rotation axes, the application unit can be adjusted in a simple manner to the transport speed of the containers, which are then provided with a material blank in a continuous process by means of the application unit.

The arrangement of the connection of the pressing element to the tool plate is in principle freely selectable. According to one particularly advantageous embodiment of the invention, however, provision is made for the pressing element to be detachably connected to the tool plate. This embodiment of the invention allows for the application unit of the packaging machine to be adapted in a particularly simple manner to changing production conditions, such as, for example, the size of the container groups, the size of the containers, or the like. In the event of a change of format, it is only necessary for the tool plate required for the processing to be arranged at the pressing element, and which, in the event of another format change, can again be replaced in a simple manner. Down-times resulting from a rearrangement of the application unit to accord with changing formats can therefore be reduced in a particularly advantageous manner.

The arrangement of the pressing element at the first and second drive disks can in principle be configured in any desired manner. There is the possibility, for example, of the pressing element being secured to the drive disks, wherein, for example, an adjustment can be made to changing production conditions, in particular to changing transport speeds of the containers, by means of a simple change to the circumferential speed of the pressing elements resulting from the rotation speed of the drive disks.

According to one advantageous embodiment of the invention, however, provision is made for the first and second drive disks to comprise receiving openings for the detachable arrangement of the jointed axles of the pressing element. The detachable arrangement of the jointed axles allows for the pressing elements to be replaced in a simple manner if required, wherein, as a result, inspection and maintenance work is also made easier.

The particularly advantageous arrangement of several receiving openings at each of the drive disks, wherein the receiving openings are arranged distributed over the circumference of the drive disks in such a way that several pressing elements can be secured to the drive disks, also makes it possible for the application unit to be provided with several pressing elements, wherein the number and arrangement of the pressing elements can then be selected as a dependency of the product divisions of the containers, wherein, for particular preference, an arrangement of the receiving openings is provided for which allows for an adjustment of the application unit to product divisions of 160 mm, 240 mm, and/or 320 mm. The expression "product division" is to be understood in this situation as the center-to-center spacing interval of two container groups following one another in the transport direction.

This embodiment of the invention therefore makes it possible, by a simple rearrangement of the pressing elements, to adjust the application unit to different product divisions, without this requiring an adjustment of the circumferential speed of the pressing elements by regulating the revolution speed of the drive disks. The circumferential speed of the pressing elements can correspond constantly to the production speed or transport speed of the packaging machine, such that different speed profiles for servomotors or the like can be avoided.

In a particularly advantageous manner, provision is made for each of the drive disks to comprise several, and preferably at least eight, receiving openings, which are arranged on a circular path with a predetermined circumference, for example a circumference of 960 mm. In this situation, the receiving openings are divided into a first group with n receiving openings arranged equidistant from one another, a second group with n receiving openings arranged equidistant from one another which are arranged opposite to the receiving openings of the first group, and two individual receiving openings each arranged in the middle between the two groups, which are arranged on a common circular path, where n is a natural number and is preferably greater than or equal to 3.

In a particularly advantageous manner, provision is made for the application unit to comprise several pressing elements, preferably three, four, or six, each comprising a tool plate, of which first jointed axles are connected to the first drive disk and of which second jointed axles are connected to the second drive disk. This allows in particular for a reliable allocation of the material blanks to the containers assembled to form four-element, six-element, or eight-element groups.

According to one particularly advantageous embodiment of the invention, at least one further application unit, and preferably at least two further application units, are provided, wherein the first and the further application unit(s) are arranged next to one another transversely to the transport direction. The application units are preferably configured as being of identical structural design to one another.

The use of several application units, which are preferably arranged next to one another transversely to the direction of transport, makes it possible for several container groups to be provided simultaneously with a material blank, as a result of which the production capacity and throughput can be increased overall. The preferred use of application units of identical structural design in this situation allows for the particularly easy and economical production of a packaging machine.

With the variant wherein the packaging machine comprises several application units, which are arranged next to one another transverse to the direction of transport, the packaging machine preferably comprises a number of storage-and-feed units corresponding to the number of the application units, and/or a number of positioning-and-folding units corresponding to the number of the application units.

The object on which the invention is based is further solved by a method for the packaging of a container group of several containers in a packaging blank, which comprises a bottom portion and several side portions, in particular with the use of a packaging machine of the type described heretofore according to the invention or further developed, wherein the method comprises the steps of arranging the container group on the bottom portion of the packaging blank, and lateral contact of the side portions of the packaging blank to the container group, and conveying of the container group along a transport plane in the transport direction through the packaging machine. The method also includes providing a material blank at an application unit, which comprises at least one pressing element, and a tool plate and continuously circulating on a circular path, in such a way that the tool plate is moved between an outer engagement position and an inner engagement position with the containers, wherein the circular path spans a plane oriented perpendicular to the transport plane, application, in particular application such as to form a bundle, of the material blank to the region of the container group opposite the bottom portion, by means of the application unit.

In order to form a stable packaging arrangement, the method according to the invention makes provision for the container group to move along a transport plane in the transport direction through the packaging machine. During the transport through the packaging machine, a suitable positioning-and-folding unit produces an arrangement of the container group which is to be packaged on a bottom portion of the packaging blank, as well as a lateral contact of the side portions, projecting laterally from the bottom portion of the packaging blank, with the container group, such that, following this, the side portions run essentially perpendicular to the bottom portion of the packaging blank.

Moreover, in order to produce a stable packaging of the container group, in the packaging machine the material blank is located in the region of the container group opposite the bottom portion, such that, overall over the bottom portion, the side portions of the packaging portion which are in contact with the side surfaces and/or front sides, as well as the material blank arranged in the region of the top side of the containers form a stable packaging. The material blank for assignment to the container group is reliably provided in this situation at the application unit by a suitable storage-and-feed unit, such that a continuous packaging of the container groups can take place, which overall exhibit a high degree of stability.

Preferably, the packaging blanks consist of board, such as corrugated board or of cardboard. For particular preference, the respective packaging blank (with its side portions in the folded state) forms what is referred to as a tray.

The sequence of the method steps, in particular the method steps of the application of the material blank and the arrangement at the packaging portion, is in principle freely selectable. Moreover, the method steps can follow one another, but not necessarily directly. It is also possible for a grouping of the container groups within the framework of the packaging machine to be avoided if these are already being provided in a grouped form.

According to one particularly advantageous embodiment of the invention, provision is made first for the container group to be formed from several containers, then for a material blank, provided at the application unit to be applied in the region of the container group opposite the bottom portion, and then for the container group to be positioned on the bottom portion of the packaging blank, and the side portions of the packaging blank to be applied laterally to the container group. This embodiment of the method according to the invention ensures, in a particularly reliable manner, the production of a stably packed container group. The application of the material blank to the container group, which takes place before the allocation to the packaging blank, stabilizes the container group in a particularly effective manner, such that the packaging blank can be applied to the container group in a particularly effective manner.

According to an alternative advantageous further embodiment of the method according to the invention, provision is made for the container group to be formed first from several containers, and next for the container group to be positioned on the bottom portion of the packaging blank, and for one or more side portions of the packaging blank to be located laterally to the container group, and then for a material blank provided at the application unit to be located in the region of the container group opposite the bottom portion.

According to this alternative further embodiment of the method according to the invention, first the container group is assigned to the packaging blank, wherein this is set up on the bottom portion, and the side portions are then brought in contact laterally with the container group. This embodiment of the invention ensures a particularly stable further transport of the container group, since, due to the packaging blank assigned to the container group, an undesirable displacement of the container group or of individual containers in relation to one another during transport will be particularly effectively avoided. The arrangement of the material blank following this in the region of the top side of the container group can then take place in a particularly reliable manner.

According to a further embodiment of the method according to the invention, provision is made for at least two and preferably at least three container groups, parallel to one another, to be connected to one or more material blanks. This embodiment of the method according to the invention allows for production capacity to be increased, which allows for the packaging machine to be used in a particularly versatile manner, i.e. also in conjunction with such systems as exhibit particularly high production capacities. In this embodiment, the container groups can be or become positioned on one and the same packaging blank or on different packaging blanks.

The configuration of the material blanks is in principle freely selectable. For example, the blanks can be delivered as already-individual items for allocation to a container group. In the event of such material blanks being provided which are configured for simultaneous assignment to several container groups, and for this purpose comprise at least two interconnected container group blanks, provision is made, however, according to a further embodiment of the method according to the invention, that during the allocation of the material blanks to the container groups, material webs which connect the material blanks to one another are separated. This embodiment of the method according to the invention makes it possible, during the procedure of allocating the material blank to the container groups, for a separation of the container group portions of the material portions to be carried out, such that the container groups provided with the material blank can be transported onwards and processed individually.

Preferred exemplary embodiments of the invention are explained hereinafter by reference to the drawings, in which:

DETAILED DESCRIPTION

Figure 1:
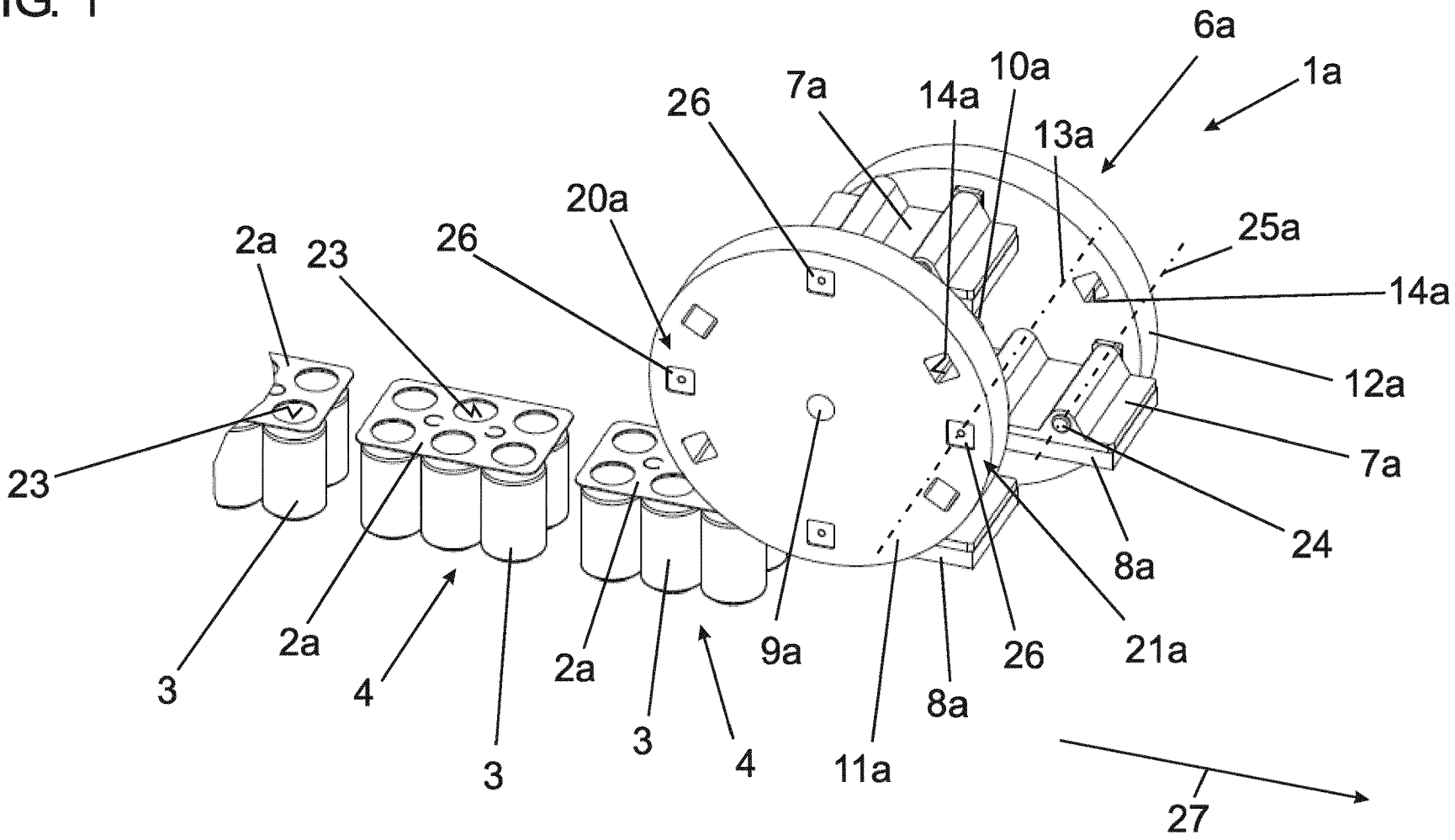
FIG. 1 shows an application unit of a packaging machine.

FIG. 1 shows a first embodiment of an application unit 1*a* in position relative to several container groups 4 moving along a transport direction 27. The container groups 4 have been assembled from containers 3 by a packaging machine, which has been omitted from the figure for clarity.

The application unit 1*a* includes a drive 6*a* that has first and second drive disks 11*a*, 12*a*. These disks 11*a*, 12*a* rotate about respective first and second rotation axes 9*a*, 10*a*. This rotation drives four pressing elements 7*a* that are distributed uniformly over the circumferences of the first and second drive disks 11*a*, 12*a*. A line perpendicular to the drive disks

11*a*, 11*b* extends across a gap between the disks 11*a*, 11*b* in a direction transverse to the transport direction 27.

The first drive disk 11*a* rotates about its first rotation axis 9*a*. The second drive disk 12*a* rotates about its second rotation axis 10*a*. The first and second rotation axes 9*a*, 10*a*, as seen in the transport direction 27, are arranged one behind another and at a distance from one another. However, the first and second rotation axes 9*a*, 10*a* are at the same height above a transport plane along which the containers 3 travel.

The drive unit 6*a* adjusts the pressing elements 7*a* using tool plates 8*a* that are arranged between the first and second drive disks 11*a*, 12*a*.

A first jointed axle 13*a* connects the pressing elements 7*a* to the first disk 11*a*. A second jointed axle 25*a* connects the pressing elements to the second disk 12*a*. Jointed bolts 24 couple the pressing elements 7*a* to the drive disks 11*a*, 12*a*. The jointed bolts 24 are mounted using rotational joints that are on the pressing elements 7*a*. These are arranged with their free ends opposite square elements 27 arranged in square receiving openings 14*a* in the first and second drive disks 11*a*, 12*a*. In some embodiments, the square elements 27 have a different shape. As a result, the square receiving openings 14*a* will also have a different shape.

The pressing elements 7*a* at the first and second drive disks 11*a*, 11*b* are arranged such that the first and second jointed axles 13*a*, 25*a* are coupled to the same pressing element 7*a*. This allows the pressing element 7*a* to maintain the same height above the transport plane. As a result, the pressing elements 7*a* and the tool plates 8*a* arranged thereon remain horizontal during the rotation of the drive disks 11*a*, 12*a*, remain parallel to the transport plane, and parallel to the containers 3 that are arranged in a container group 4 traveling along the transport plane.

Each of the first and second drive disks 11*a*, 12*a* has a first group 20*a* of three receiving openings 14*a*. The three receiving openings 14*a* of the first group 20*a* are arranged to be equidistant from each other along the disk's circumference. Similarly, each of the first and second drive disks 11*a*, 12*a* has a second group 21*a* of three receiving openings 14*a*. The three receiving openings 14*a* of the second group 21*a* are likewise arranged to be equidistant from each other along the disk's circumference.

The receiving openings 14*a* of the first group 20*a* on the first drive disk 11*a* are located opposite corresponding receiving openings 14*a* of the first group 20*a* on the second drive disk 11*b*. Similarly, receiving openings 14*a* of the second group 21*a* on the first drive disk 11*a* are located opposite corresponding receiving openings 14*a* of the second group 21*a* on the second drive disk 11*b*. Two further receiving openings 14*a* are each arranged opposite each other in the middle between the first group 20*a* and the second group 21*a* on the circular path.

The drive unit rotates the first and second drive disks 11*a*, 12*a* about their respective rotation axes 9*a*, 10*a*. As a result, the pressing elements 7*a* rotate, with their respective tool plates 8*a*, about the first and second rotation axes 9*a*, 10*a*. As they do so, the tool plates 8*a* come into engagement with containers 3 that have been assembled to form container groups 4, In doing so, they move the material blanks 2*a*, which have been arranged on the container groups 4, in the direction onto the containers 3.

In the position shown in FIG. 1, the blanks 2*a* are laid onto the container groups 4 to form bundles. In the position shown in FIG. 2, the holes 23 of the material blanks 2*a* are laid over the top side of the containers 3 such that the holes 23 and containers 3 are coaxial at the top ends of the containers 3.

Figure 2:
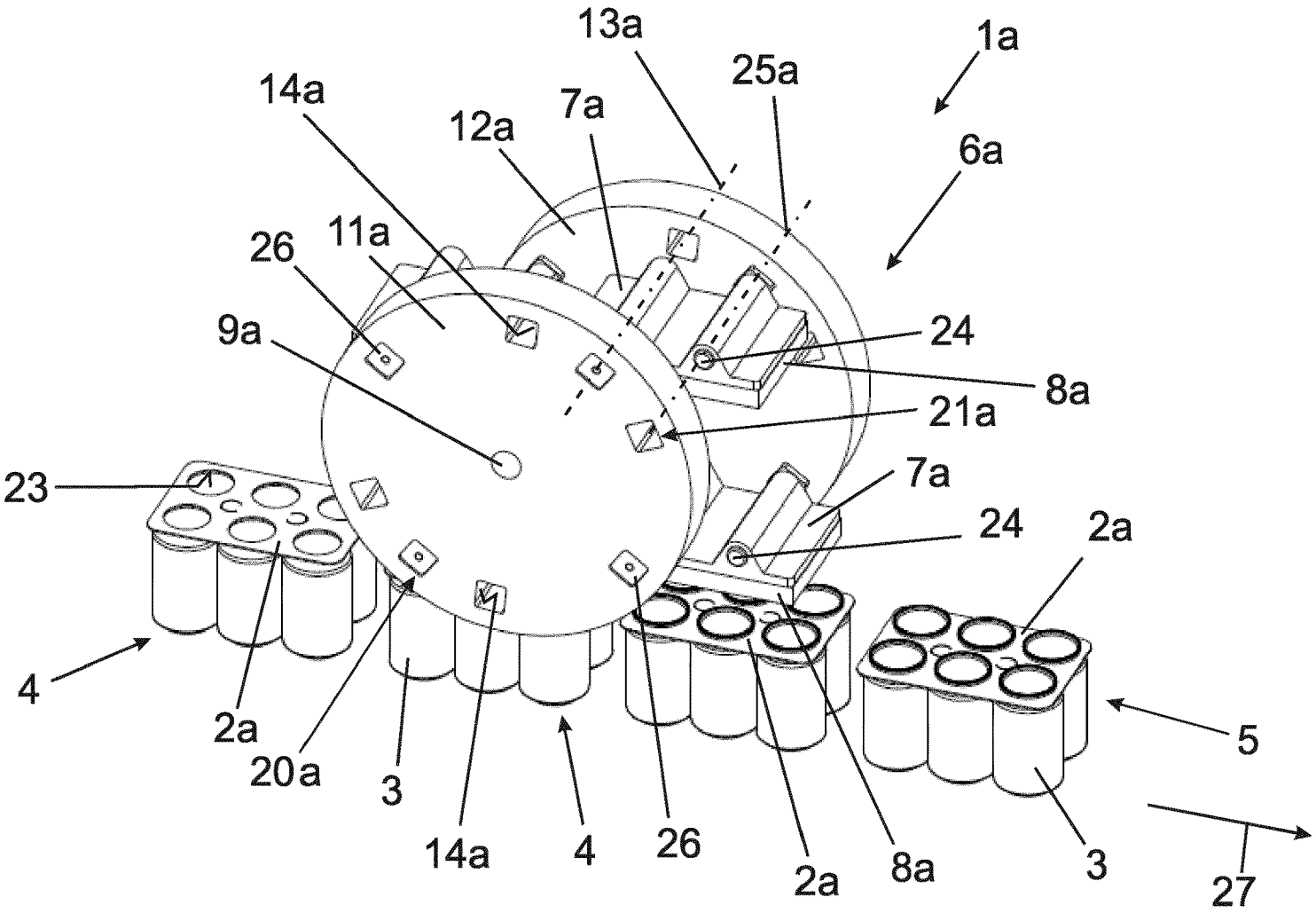
FIG. 2 shows the application unit from FIG. 1, in interaction with grouped containers.

As the container groups 4 are guided along the transport direction 27, an interaction with the tool plates 8*a* moves the material blanks 2*a* from the position shown in FIG. 1 to that shown in FIG. 2. In the course of this interaction, the tool plates 8*a* guide the material blanks 3, hold them parallel to the top ends of the containers 3, and move them from an outer engagement position into an inner engagement position with the container groups 4.

Figure 3:
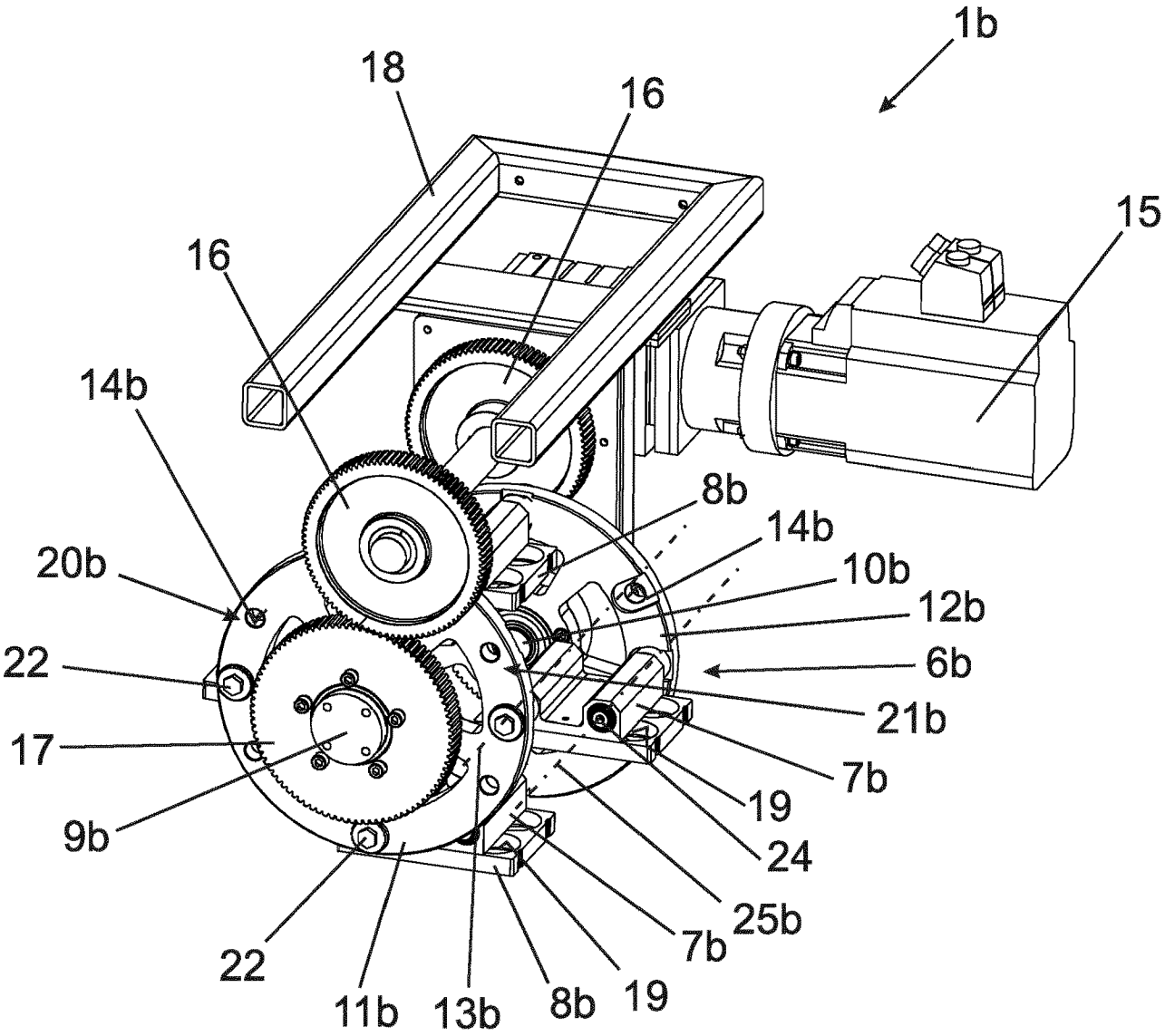
FIG. 3 shows a second embodiment of an application unit of a packaging machine.

FIG. 3 shows an alternative embodiment of an application unit 1*b*. The application unit 1*b* features a drive unit 6*b* that comprises two wheel-shaped drive disks 11*b*, 12*b*. The first drive disk 11*b* rotates about a first rotation axis 9*b* and the second drive disk 12*b* rotates about a second rotation axis 10*b*. Screws 22 provide a jointed arrangement of the pressing elements 7*b* at the first drive disk 11*b* and at the second drive disk 12*b* by means of which jointed bolts 24, extending through the pressing elements 7*b*, form a joint with the first and second drive disks 11*b*, 12*b*. These jointed bolts 24 form the first and second jointed axes 13*b*, 25*b* of the pressing elements 7*b*.

Unlike the receiving openings 14*a* of the drive unit 6*a* shown in FIGS. 1 and 2, the first and second drive disks 11*b*, 12*b* of the application unit 1*b* shown in FIG. 3 comprise circular receiving openings 14*b* through which the screws 22 extend. By analogy with the embodiment shown in FIG. 1 and FIG. 2, the first and second drive disks 11*b*, 12*b* comprise first and second groups 20*b*, 21*b* of receiving openings, which are arranged opposite one another. Two additional receiving openings 14*b* are arranged between the two receiving opening groups 20*b*, 21*b*, along the circular path between the two receiving opening groups 20*b*, 21*b*.

A drive motor 15 arranged at a frame 18 drives the drive unit 6*b*. A pair of first toothed wheels 16 transfers the drive motor's rotational movement to a pair of second toothed wheels 17 that are connected to provide torque that turns the drive disks 11*b* 12*b*. In a preferred embodiment, the drive motor 15 is an electric motor, and in particular, a servomotor.

The drive unit 6*b* sets the first and second drive disks 11*b*, 12*b* into rotation about their first and second rotation axes 9*b*, 10*b*. As a result, the pressing elements 7*b*, with their allocated tool plates 8*b*, which are permanently horizontal, rotate with the drive disks 11*b*, 12*b*.

The tool plate 8*b* comprises openings 19 that match the containers 3 of the container groups 4 that are to be processed. This allows for a displacement of the material blank 2*a* in the direction of the containers 3, thus forming the bundles 5.

Figure 4A:
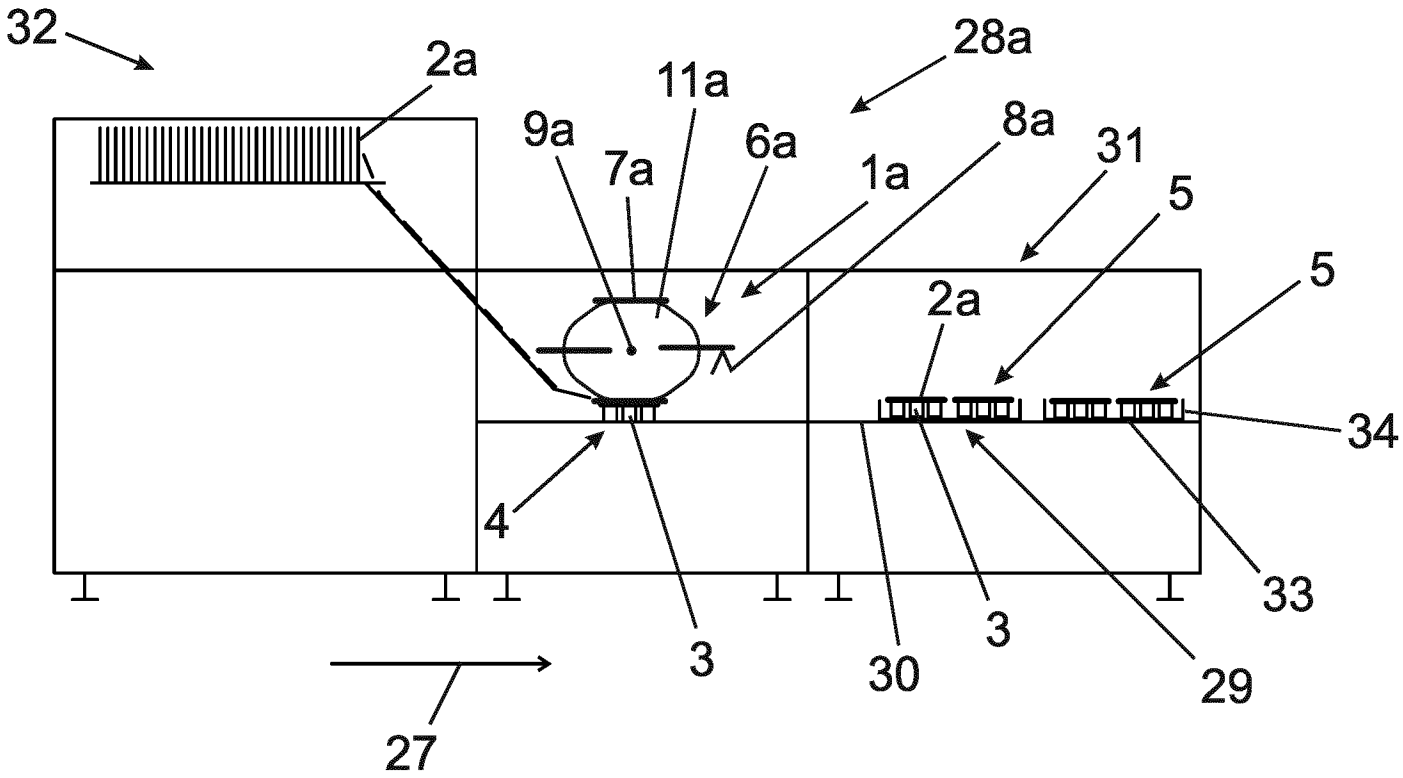
FIG. 4*a* shows a first embodiment of a packaging machine with several application units.

FIG. 4*a* shows a packaging machine 28*a* having three application units 1*a* and three associated storage-and-feed units 32. The three application units 1*a* and the three storage-and-feed units 32 are arranged next to one another transversely to the transport direction 27. As a result of the perspective shown in FIG. 4*a*, only one of the three application units 1*a* and only one of the three storage-and-feed units 32 can be seen. Since the three application units 1*a* have identical structure and function, reference is made hereinafter only to one of the application units 1*a*.

Figure 4B:
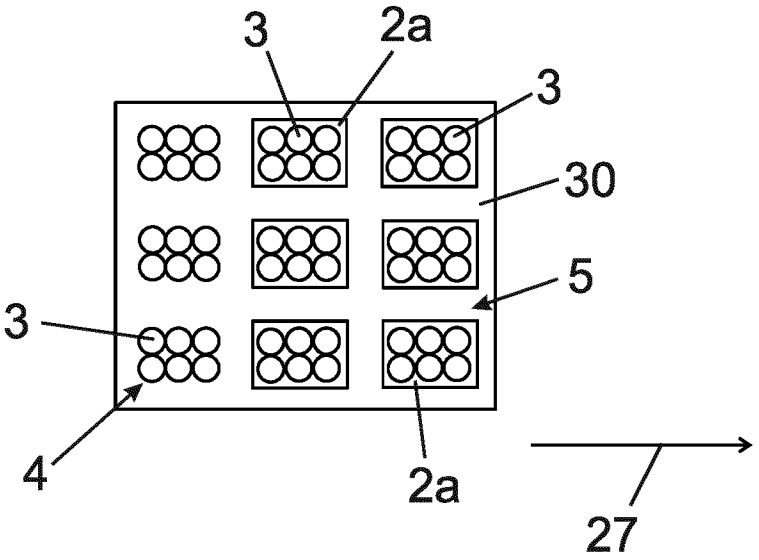
FIG. 4*b* shows a view from above onto the packaging machine from FIG. 4*a* in the region of the application units.

Containers 3 that have been assembled to form a container group 4 are guided along the transport direction 27 in the packaging machine 28*a* towards the application unit 1*a*. Meanwhile, material blanks 2*a*, which are stored in the storage-and-feed unit 32, are guided to the application unit 1*a* to be attached to the container groups 4. FIG. 4*b*, which is a view from above, shows three such container groups 4 in parallel. This corresponds to the three application units 1*a* referred to in connection with FIG. 4*a*.

A positioning-and-folding unit 31 follows the application unit 1*a* in the transport direction 27. Within the positioning-and-folding unit 31, the bundles 5 are arranged on a bottom portion 33 of a packaging blank 29. The side portions 34 of the packaging blank 29, which project laterally from its bottom portion 33, are then brought into contact with the sides of the bundle 5. A transport belt 30 then conveys the bundles 5 out of the packaging machine 28*a*.

Figure 5A:
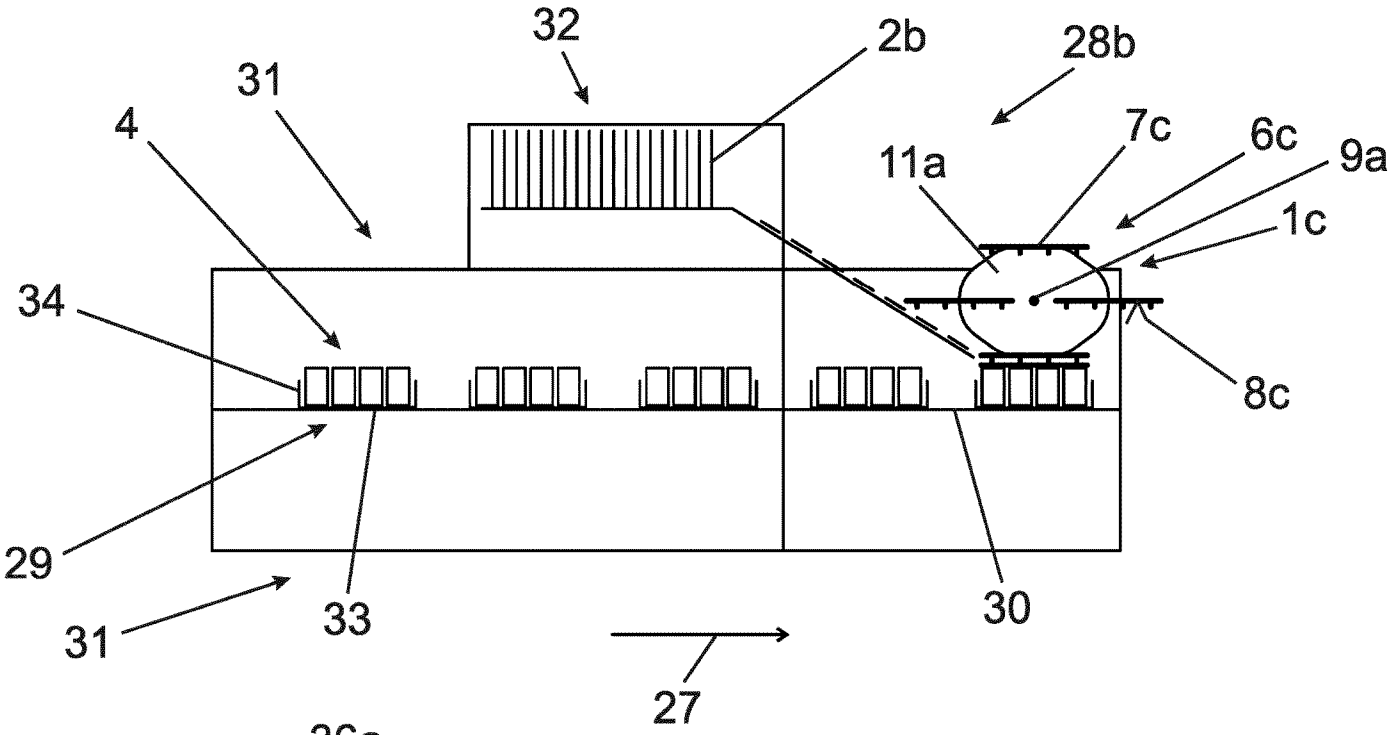
FIG. 5*a* shows a sectional representation of a further embodiment of a packaging machine with an application unit.
Figure 5C:
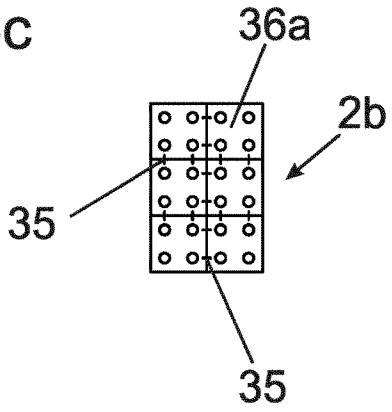
FIG. 5*c* shows a view from above onto a material blank processed in the packaging machine according to the FIG. 5*a;*
Figure 5B:
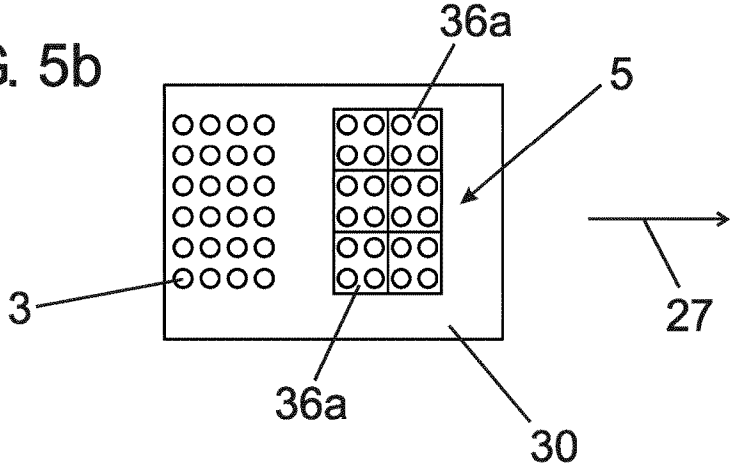
FIG. 5*b* shows a view from above onto the packaging machine from FIG. 5*a* in the region of the application unit.

FIG. 5*b* shows a further embodiment of a packaging machine 28*b*. Unlike that shown in FIG. 4*a*, the packaging machine 28*b* of FIG. 5*a* has only one application unit 1*c* and only one storage-and-feed unit 32. Additionally, the positioning-and-folding unit 31 is upstream of the application 1*c*. Within the positioning-and-folding unit 31, the container groups 4 are arranged on the bottom portions 33 of the packaging blanks 29. The side portions 34 of the packaging blanks 29, which project from the bottom portion 33, are brought into contact with the sides of the container groups 4. Material blanks 2*b* provided and delivered by the storage-and-feed unit 32 are guided to the application unit 1*c*.

Unlike the packaging machine 28*a* represented in FIG. 4*a*, the drive unit 6*c* of the application unit 1*c* comprises tool plates 8*c* that are configured such as to separate the material blanks 2*b* from one another to form several container group portions 36*a*.

In an exemplary embodiment shown in FIG. 5*c*, an arrangement of connecting webs 35 defines a material blank 2*b* that has six container group portions 36*a* in a 3×2 arrangement. The tool plate 8*c* comprises cutting elements 37 that separate the container group portions 36*a* from one another during the application of the material blank 2*b* to the container groups 4. Following this, the bundles 5, which are arranged on and later in the packaging blank 28*b* and provided with the material blanks 2*b*, are transported out of the packaging machine 28*b*.

Figure 6A:
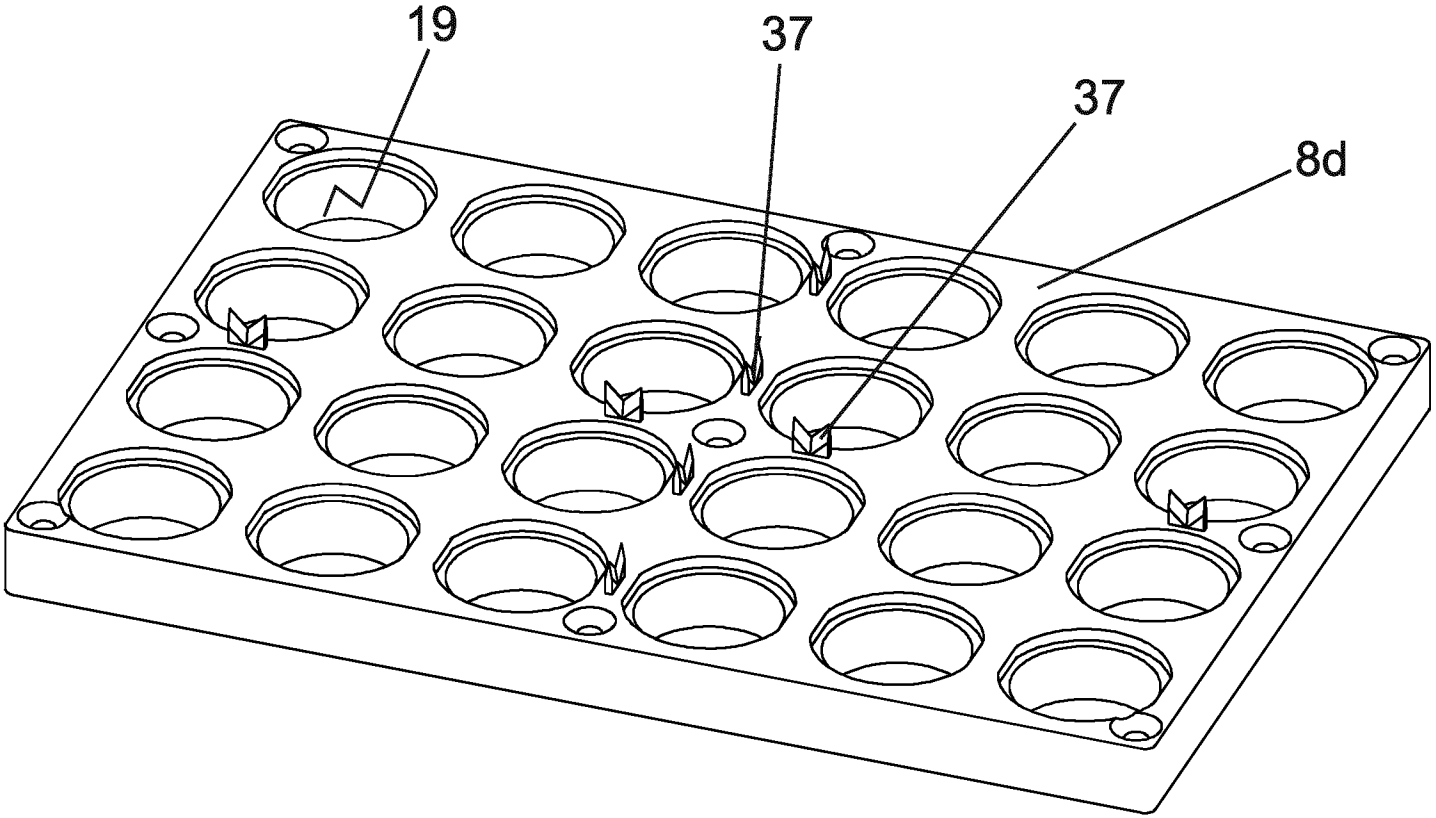
FIG. 6*a* shows a perspective view of an embodiment of a tool plate.
Figure 6B:
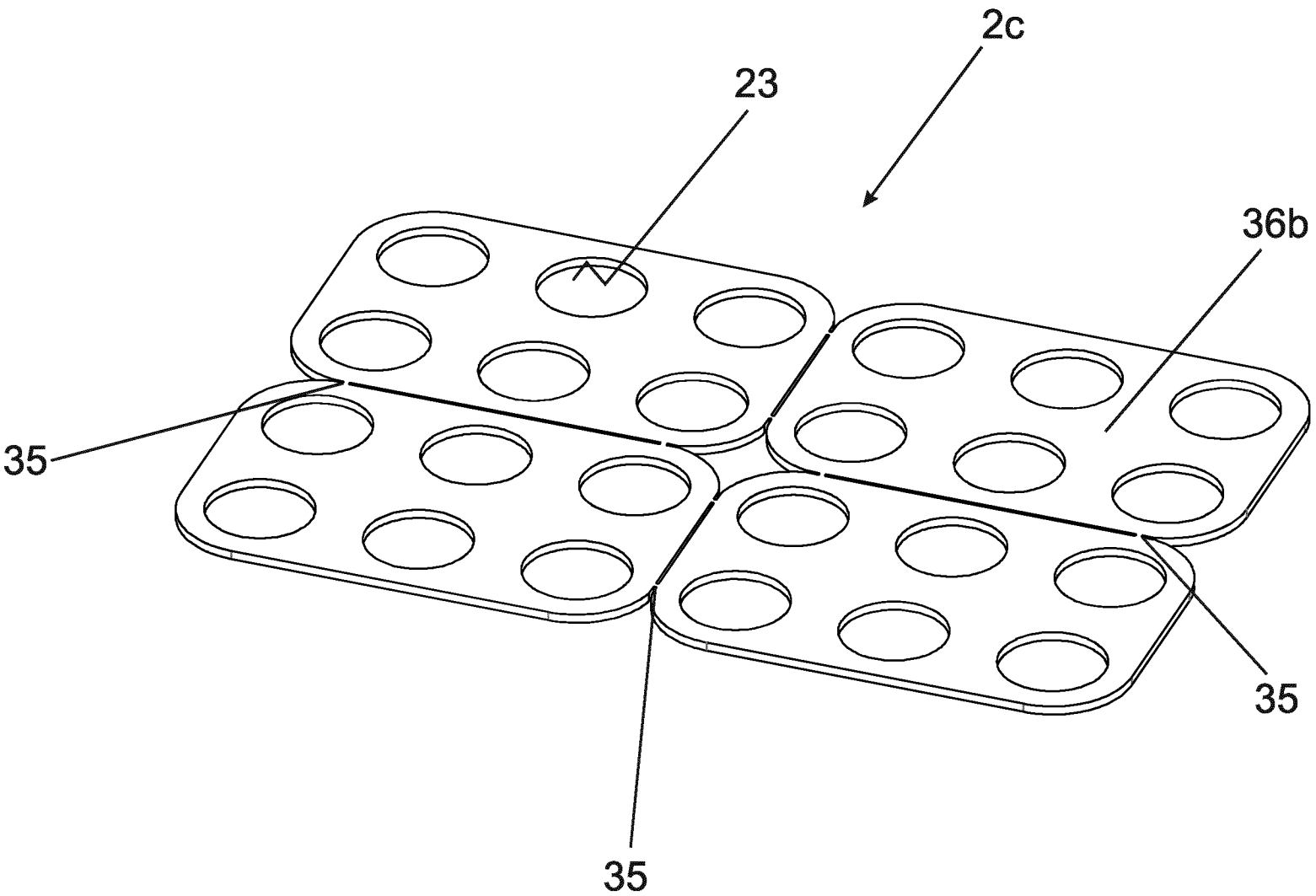
FIG. 6*b* shows a perspective view of a further embodiment of a material blank.

FIG. 6*a* shows a further embodiment of a tool plate 8*d* to process the material blanks 2*c* according to FIG. 6*b*. Each of these material blanks 2*c* defines four container group sections 36*b*.

Figure 6C:
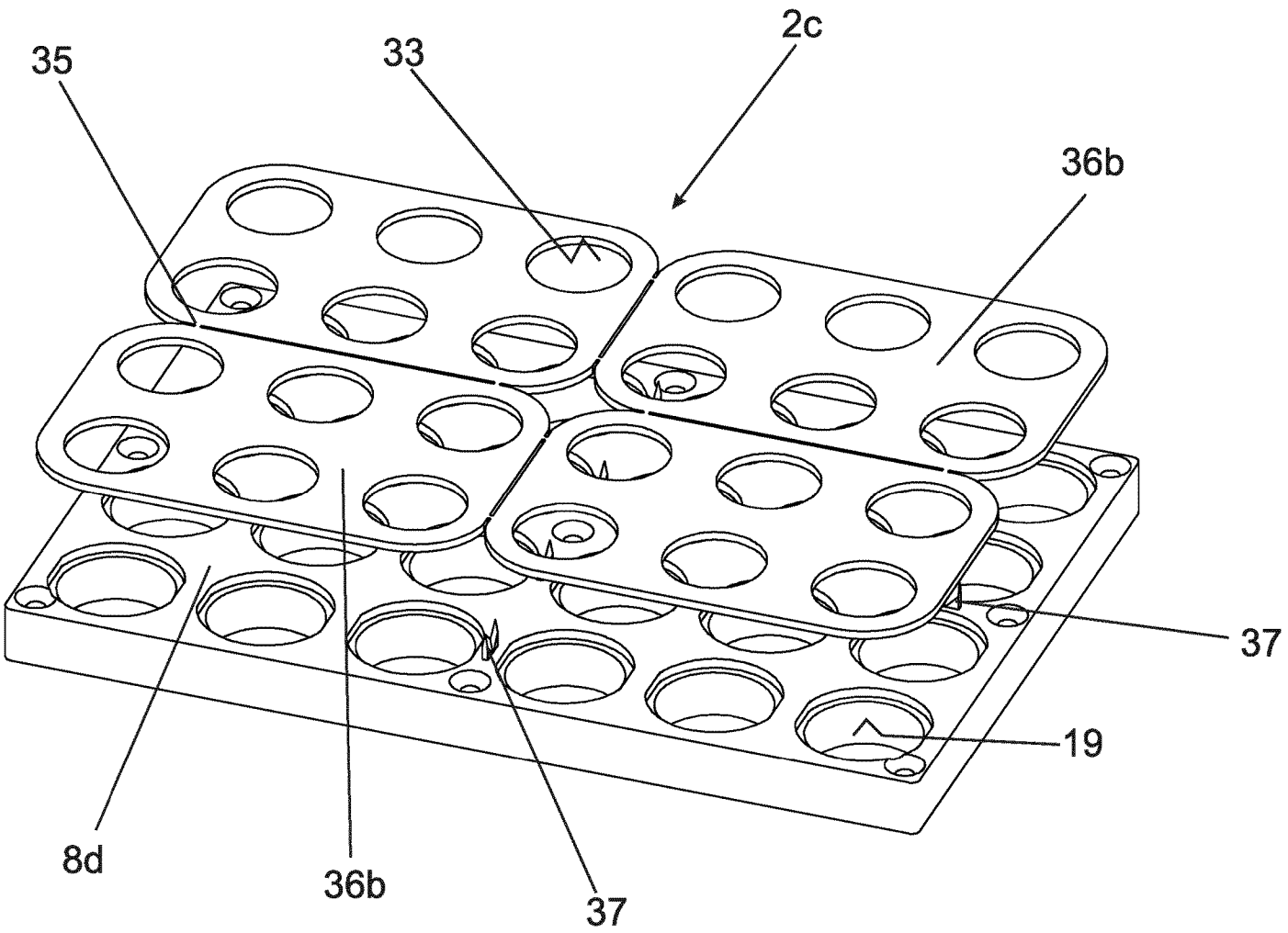
FIG. 6*c* shows a perspective representation of an interaction of the material blank from FIG. 6*b* with the tool plate according to FIG. 6*a*.

The tool plate 8*d* comprises cutting elements 37 extending in the transport direction 27 and transverse to the transport direction 27. The cutting elements 37 are configured such as to separate the connecting webs 35 of the material blank, which connect the container group sections 36*b* as shown in FIG. 6*b*. The interaction of the tool plate 8*d* with the material blank 2*c* is illustrated in the perspective view shown in FIG. 6*c*.

The invention claimed is:

1. An apparatus comprising a packaging machine, said packaging machine comprising a tray packer for packing a container group that includes containers in a packaging blank, said packaging blank including a bottom portion and side portions, wherein said tray packer comprises a positioning-and-folding unit, a transport unit, an application unit, and a storage-and-feed unit, wherein said positioning-and-folding unit is configured for arranging said container group on said bottom portion and for laterally placing said side portions against said container group, wherein said transport unit comprises a transport belt that is configured for conveying said container group along a transport plane in a transport direction through said packaging machine, wherein said application unit is configured for placing a material blank on said container group opposite said bottom portion such as to form a bundle, wherein said storage-and-feed unit is configured for storing and providing said material blanks to said application unit, wherein said application unit comprises a pressing element that comprises a tool plate that moves continuously on a circular path in such a way that said tool plate transitions between an outer engagement position and an inner engagement position with said containers, and wherein said circular path lies in a plane that is oriented perpendicular to said transport plane, wherein said application unit comprises a drive unit that is configured such as to move said pressing element in such a way that said tool plate transitions between an outer engagement position and an inner engagement position with said containers, wherein said drive unit comprises a first drive disk and a second drive disk, said first and second drive disks being parallel and separated from each other by a distance, wherein said first and second drive disks are rotatable about respective first and second rotation axes that are oriented perpendicular to said transport direction, parallel to said transport plane, separated from said transport plane by an interval, and offset from each other along said transport direction, wherein said pressing element comprises first and second jointed axles, wherein said pressing element is connected by said first jointed axle in a jointed manner to said first drive disk, and wherein said pressing element is connected by said second jointed axle in a jointed manner to said second drive disk in such a way that, at a rotation of said two drive disks about said respective rotation axes, said tool plate is oriented parallel to said transport plane.

2. The apparatus of claim 1, further comprising a formatting unit for forming said container group, wherein said application unit follows said formatting unit in said transport direction and wherein said positioning-and-folding unit follows said application unit in said transport direction.

3. The apparatus of claim 1, further comprising a formatting unit for forming said container group, wherein said positioning-and-folding unit follows said formatting unit in said transport direction and wherein said application unit follows said positioning-and-folding unit in said transport direction.

4. The apparatus of claim 1, wherein said tray packer is further configured for covering said container group with a shrink film and for shrinking said shrink film.

5. The apparatus of claim 1, wherein said application unit is configured for separating said material blanks and wherein said tool plate comprises cutting elements for separating connecting webs that connect container group portions of said material blanks.

6. The apparatus of claim 1, wherein said pressing element is configured such that said tool plate is detachable.

7. The apparatus of claim 1, wherein said first and said second drive disks comprise receiving openings for detachable arrangement of said jointed axles.

8. The apparatus of claim 1, wherein each of said drive disks comprises several receiving openings distributed along a corresponding circumference of said drive disk such that several pressing elements are securable to said drive disks, and wherein said receiving openings are separated by any one of a plurality of selectable distances, said selectable distances being product divisions of 160 millimeters, 240 millimeters, and 320 millimeters.

9. The apparatus of claim 1, wherein each of said drive disks comprises at least eight receiving openings arranged around a circular path having a circumference of 960 millimeters, wherein at least three receiving openings are arranged equidistant from one another in a first group, at least three receiving openings are arranged equidistant from one another in a second group and opposite said receiving openings of said first group, and wherein two individual receiving openings are arranged between said first and second groups, which are all arranged along said circular path.

10. The apparatus of claim 1, wherein said application unit is a first application unit and said tray packer further comprises second and third application units, wherein said second and third application units are arranged next to one another transversely to said transport direction, and wherein said application units are of identical structural design.

11. A method comprising packing a container group of several containers in a packaging blank that has a bottom portion and side portions, wherein packing said container group comprises using a packaging machine to carry out steps of arranging said container group on said bottom portion, laterally placing said side portions against said container group, conveying said container group on a transport belt along a transport plane in a transport direction through said packaging machine, providing a material blank to an application unit, and applying said material blank to a region of said container group, which is opposite said bottom portion, using said application unit, thereby forming a bundle, wherein said application unit comprises a drive unit and a pressing element that comprises a tool plate that moves continuously on a circular path in such a way that said tool plate transitions between an outer engagement position and an inner engagement position with said containers and wherein said circular path lies in a plane that is oriented perpendicular to said transport plane, and wherein said drive unit moves said pressing element, wherein said drive unit comprises a first drive disk and a second drive disk, said first and second drive disks being parallel and separated from each other by a distance, wherein said first and second drive disks are rotatable about respective first and second rotation axes that are oriented perpendicular to said transport direction, parallel to said transport plane, separated from said transport plane by an interval, and offset from each other along said transport direction, wherein said pressing element comprises first and second jointed axles, wherein said pressing element is connected by said first jointed axle in a jointed manner to said first drive disk, and wherein said pressing element is connected by said second jointed axle in a jointed manner to said second drive disk in such a way that, at a rotation of said two drive disks about said respective rotation axes, said tool plate is oriented parallel to said transport plane.

12. The method of claim 11, further comprising forming said container group from several containers, applying a material blank, which has been provided at said application unit, to a region of said container group that is opposite said bottom portion, positioning said container group on said bottom portion of said packaging blank, and placing one or more side portions of said packaging blank laterally against said container group.

13. The method of claim 11, further comprising forming said container group from several containers, positioning said container group on said bottom portion, placing one or more of said side portions of said packaging blank laterally against said container group, and placing a material blank in a region of said container group that is opposite said bottom portion, said material blank having been provided at said application unit.

14. The method of claim 11, wherein said container group is one of several container groups that are parallel to each other and wherein said method further comprises connecting said container groups to one or more material blanks.

15. The method of claim 11, wherein said container group is one of several container groups that are parallel to each other and wherein said method further comprises connecting said container groups to one or more material blanks and, while doing so, separating webs that connect material blanks to each other.

* * * * *